US005870867A

United States Patent [19]

Mitchell

[11] Patent Number: 5,870,867

[45] Date of Patent: Feb. 16, 1999

[54] SOLID CORE PARTITION WALL

[75] Inventor: Terry Mitchell, Grand Rapids, Mich.

[73] Assignee: Steelcase Inc., Grand Rapids, Mich.

[21] Appl. No.: 763,698

[22] Filed: Dec. 9, 1996

[51] Int. Cl.[6] ..... E04C 2/52

[52] U.S. Cl. ..... 52/220.1; 52/268; 52/269; 52/270; 52/591.4; 52/591.5; 52/309.9

[58] Field of Search ..... 52/220.1, 269, 52/268, 270, 591.4, 591.5, 309.9, 122, 126.1, 36, 238, 239, 275, 309.7, 309.2, 592.1, 784.14, 784.15, 787.11, 783.11

[56] References Cited

U.S. PATENT DOCUMENTS

| | | | |
|---|---|---|---|
| 2,260,178 | 10/1941 | Guignon, Jr. . | |
| 3,449,877 | 6/1969 | Beckman . | |
| 3,462,892 | 8/1969 | Meyer . | |
| 3,733,756 | 5/1973 | Butler . | |
| 3,848,364 | 11/1974 | Costruba . | |
| 4,112,648 | 9/1978 | Suzuki et al. | 52/268 X |
| 4,114,333 | 9/1978 | Jones et al. | 52/265 |
| 4,120,124 | 10/1978 | Temple et al. . | |
| 4,157,638 | 6/1979 | Della-Donna | 52/591.5 X |
| 4,251,968 | 2/1981 | Raith et al. . | |
| 4,356,672 | 11/1982 | Beckman et al. . | |
| 4,375,010 | 2/1983 | Mollenkopf . | |
| 4,438,614 | 3/1984 | Raith et al. . | |
| 4,478,018 | 10/1984 | Holand | 52/220.1 |
| 4,501,101 | 2/1985 | Davis | 52/268 X |
| 4,535,577 | 8/1985 | Tenser et al. . | |
| 4,555,283 | 11/1985 | Thesenfitz | 52/268 X |
| 4,559,410 | 12/1985 | Hostetter . | |
| 4,581,859 | 4/1986 | Doke et al. . | |
| 4,610,118 | 9/1986 | Fullenkamp . | |
| 4,612,744 | 9/1986 | Shamash | 52/220.1 |
| 4,631,881 | 12/1986 | Charman . | |
| 4,757,657 | 7/1988 | Mitchell et al. . | |
| 4,841,699 | 6/1989 | Wilson et al. . | |
| 4,862,659 | 9/1989 | Wilson et al. . | |
| 4,881,352 | 11/1989 | Glockenstein . | |
| 4,884,375 | 12/1989 | Wendt . | |
| 4,918,888 | 4/1990 | Giles et al. | 52/220.1 X |
| 4,944,122 | 7/1990 | Wendt . | |
| 5,007,222 | 4/1991 | Raymond | 52/220.1 X |
| 5,038,539 | 8/1991 | Kelley et al. . | |
| 5,056,285 | 10/1991 | Frascaroli et al. . | |
| 5,062,246 | 11/1991 | Sykes . | |
| 5,065,556 | 11/1991 | Delong et al. . | |
| 5,081,808 | 1/1992 | Bastian et al. . | |
| 5,154,030 | 10/1992 | Harms . | |
| 5,159,793 | 11/1992 | Deugo et al. . | |
| 5,172,530 | 12/1992 | Fishel et al. . | |
| 5,214,889 | 6/1993 | Nienhuis et al. . | |
| 5,214,890 | 6/1993 | Levitan et al. . | |
| 5,227,005 | 7/1993 | Hellwig et al. | 52/220.1 |
| 5,277,005 | 1/1994 | Hellwig et al. . | |
| 5,277,006 | 1/1994 | Ruster . | |
| 5,287,675 | 2/1994 | McGee . | |
| 5,305,567 | 4/1994 | Wittler . | |
| 5,309,686 | 5/1994 | Underwood et al. . | |
| 5,337,525 | 8/1994 | Zacca et al. | 52/220.1 X |
| 5,357,055 | 10/1994 | Sireci . | |
| 5,362,923 | 11/1994 | Newhouse et al. . | |
| 5,377,466 | 1/1995 | Insalaco et al. . | |
| 5,406,760 | 4/1995 | Edwards . | |
| 5,433,046 | 7/1995 | MacQuarrie et al. . | |
| 5,497,589 | 3/1996 | Porter | 52/309.9 X |

*Primary Examiner*—Carl D. Friedman
*Assistant Examiner*—W. Glenn Edwards
*Attorney, Agent, or Firm*—Price, Heneveld, Cooper, Dewitt & Litton

[57] ABSTRACT

A wall system which can be reconfigured and reused as needed, and which provides improved fire resistance and acoustical resistance, includes a plurality of edge connected panels having a solid structural core, a plurality of spaced apart structural studs attached to opposite faces of the panels, and a plurality of cover panels attached to outboard faces of the studs. The solid structural core comprising off-set gypsum panels forming a lipped edge which is adapted to connect to an adjacent solid core wall panel in overlapped interlocking relationship whereby improved acoustical and fire insulating properties are achieved.

24 Claims, 11 Drawing Sheets

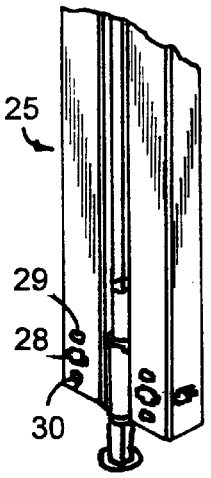
Fig. 3
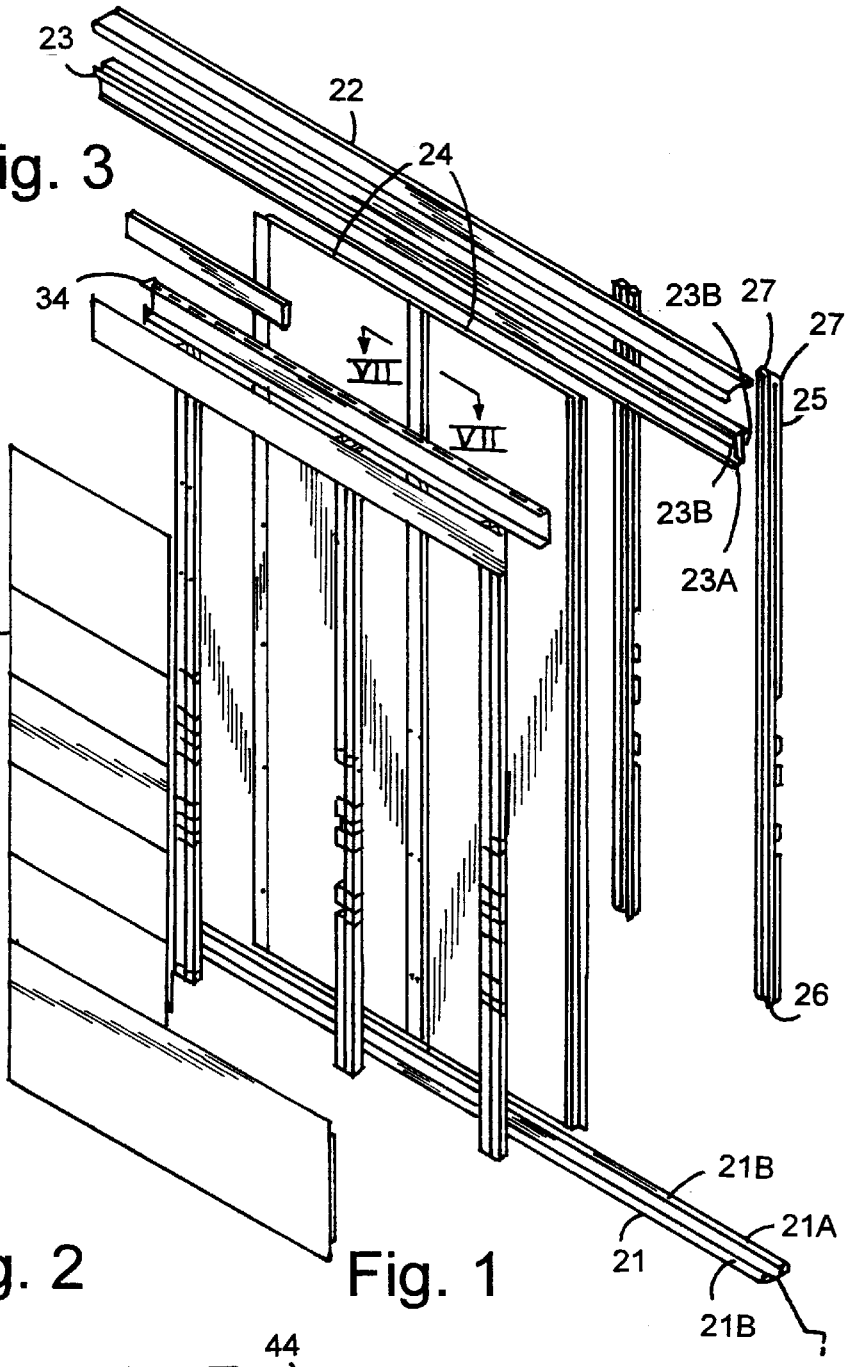
Fig. 1
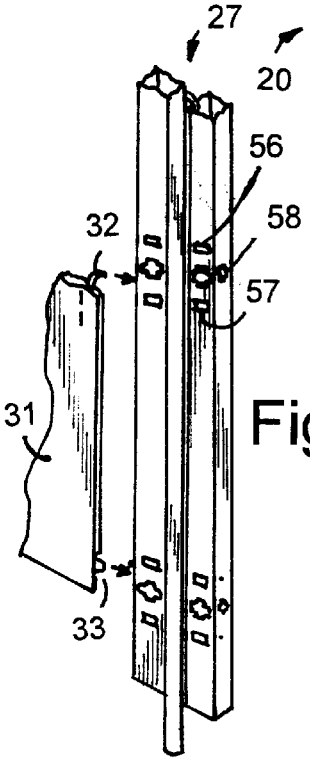
Fig. 2
Fig. 7
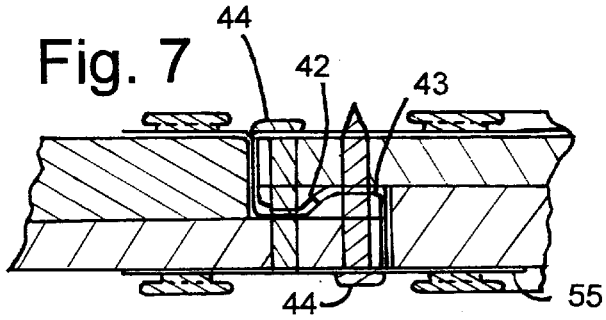

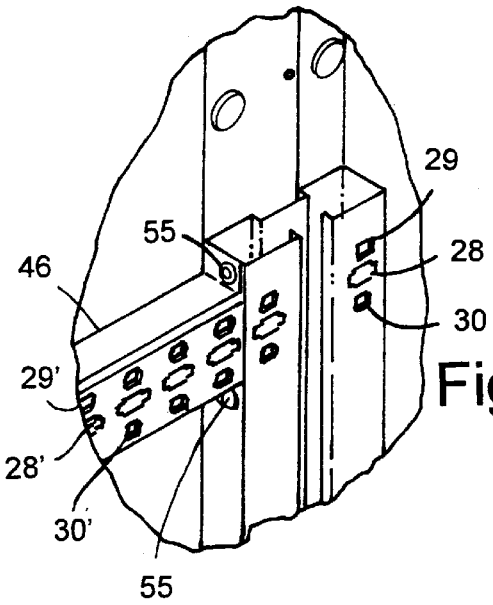
Fig. 11
Fig. 9
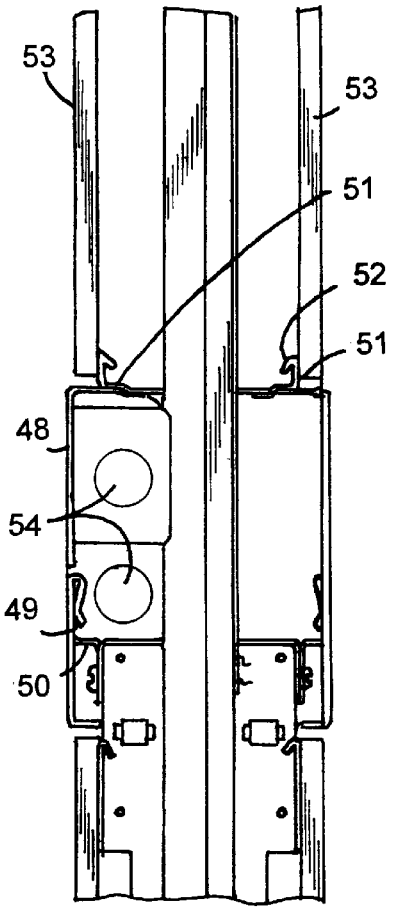
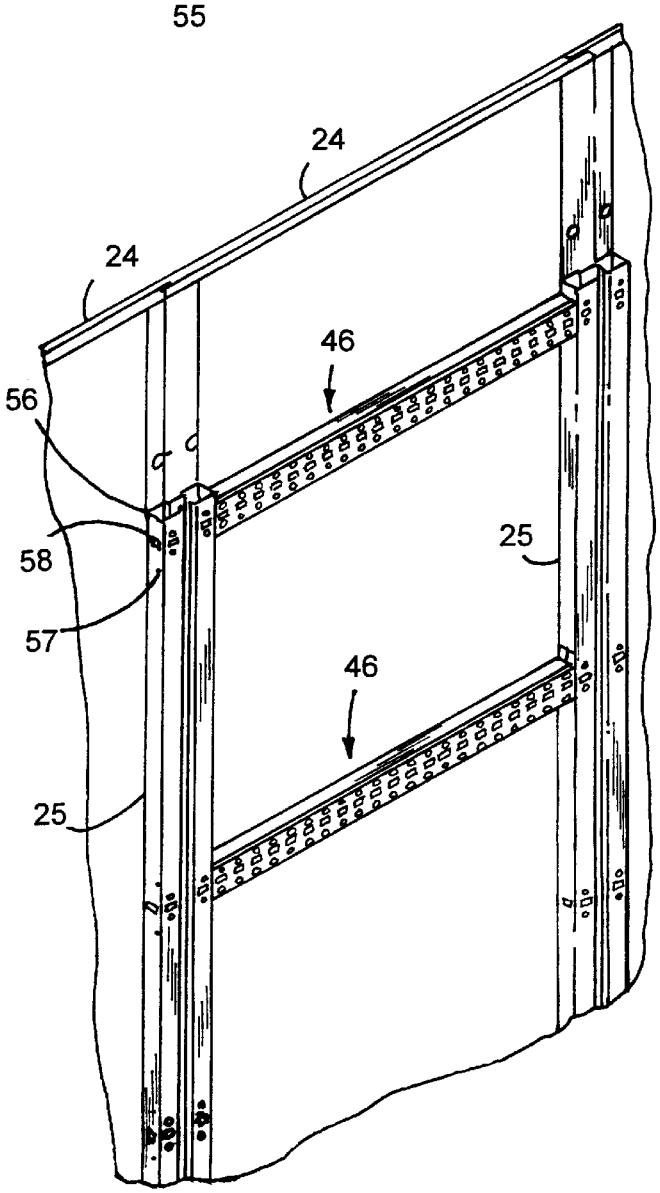
Fig. 10

Fig. 21
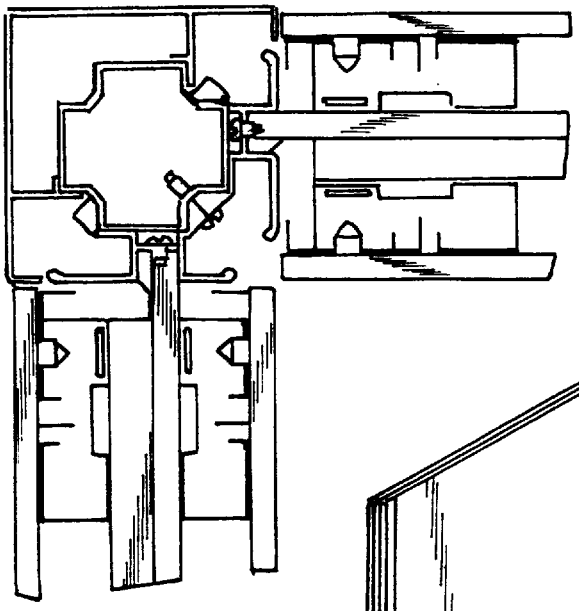
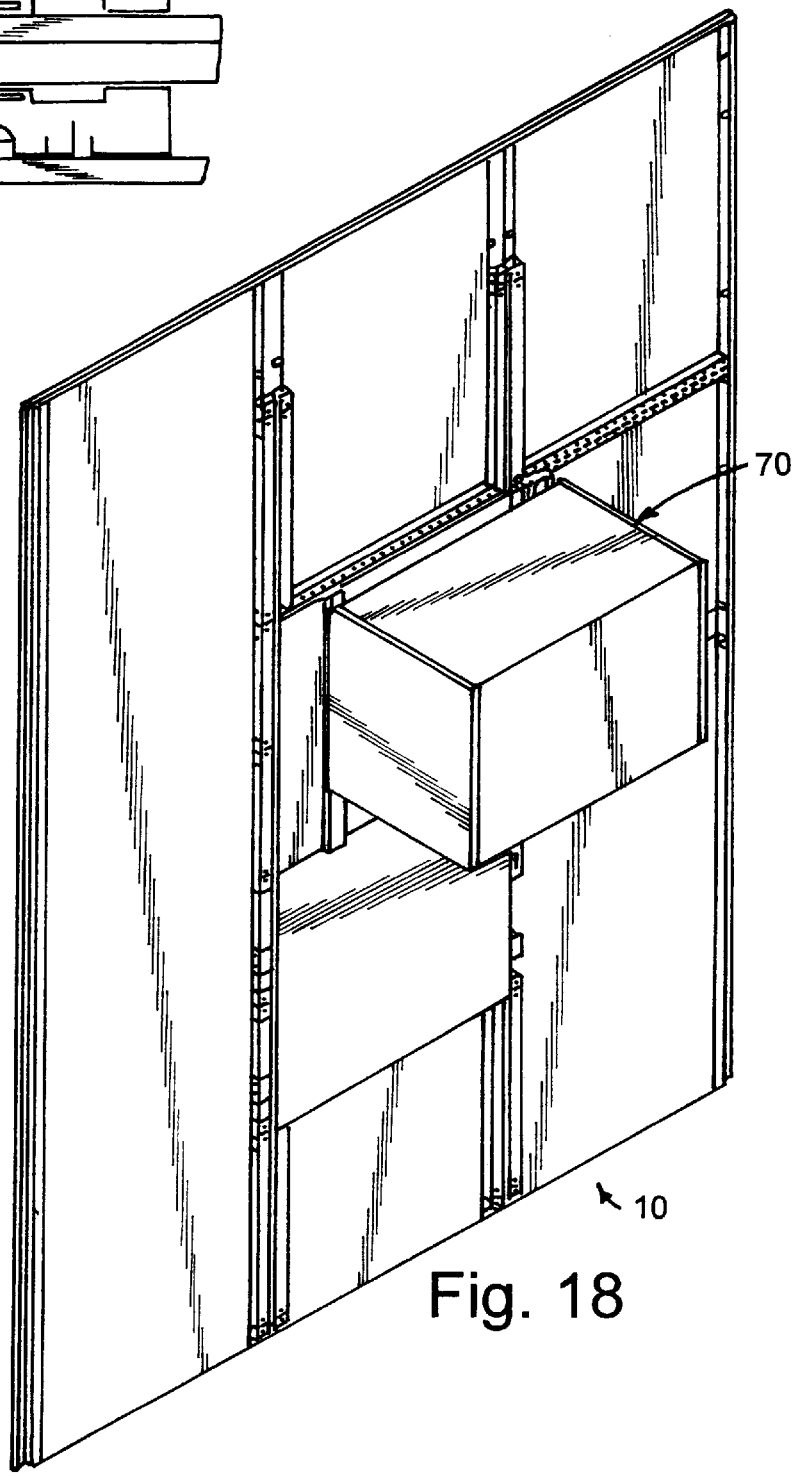
Fig. 18

SOLID CORE PARTITION WALL

FIELD OF THE INVENTION

This invention relates to walls systems which can be reconfigured and reused as needed, and more particularly to a reconfigurable wall system having solid core panels which provide improved fire resistance and acoustical resistance.

BACKGROUND OF THE INVENTION

Wall panel systems for interior construction in buildings are well known. However, conventional interior wall panel systems are generally comprised of a plurality of interconnected hollow core partition panels, which in many cases do not provide adequate acoustical resistance, and which provide less fire resistance than might be desired. Known wall panel systems which are comprised of solid core panels, such as gypsum wall panels, are not interconnected in edge to edge relationship, but are instead connected to studs which are interposed between adjacent panels. The studs in these wall systems are generally hollow. Accordingly, while these known systems having solid core wall panels provide improved acoustic resistance and possibly improved fire resistance with respect to more typical wall systems having hollow core partition panels, the hollow studs provide an acoustic gap having a lower acoustic resistance than the solid core wall panels connected thereto, thus diminishing the benefits of the acoustic insulating properties of the solid core wall panels. Therefore, because of the hollow studs, known wall systems incorporating solid core wall panels do not achieve optimum utilization of the sound insulating properties of the solid core panels. The hollow studs may also provide reduced fire resistance as compared with the solid core wall panels attached thereto, thus acting as gaps which are susceptible to fire propagation in an otherwise relatively fire resistant wall.

Another disadvantage with known wall panel systems incorporating solid core wall panels is that they do not facilitate selection of a variety of different wall coverings or skins which can be easily installed and dismounted and replaced with different wall coverings as desired. Instead, the known partition systems incorporating solid core wall panels generally have gypsum outer panels or other surfaces which can be painted or provided with a desired wall covering, such as wallpaper, which must be recovered in a conventional manner if a different wall covering is desired.

A further disadvantage with known wall panel systems incorporating solid core wall panels is that the do not provide means for facilitating utility modules, such as for supporting an electrical receptacle, means for facilitating mounting of furniture to the wall system, or means for facilitating connection of perpendicular walls (off-walls) off of the wall systems from generally any selected location along the wall system.

With respect to particular known wall systems, U.S. Pat. No. 4,356,672 to Beckman discloses a partition system including gypsum sheets that can be covered with paneling, wallpaper, paint or other materials. However, Beckman does not disclose a solid core wall, but instead discloses a wall having an internal space therein. U.S. Pat. No. 5,287,675 to McGee discloses a wall stud assembly including a solid wall interconnected by studs located between the solid wall sections. The solid wall sections extend between a ceiling channel and a floor channel. The studs between adjacent solid wall sections is generally hollow, thus providing an acoustical gap which may also be more susceptible to fire propagation than the panels connected thereto. Also, the solid core panels disclosed by McGee are not comprised of solid gypsum, but instead are comprised of a honeycomb core with vinyl covered hardboard on each side, or a non-combustible insulating core such as polystyrene foam with gypsum panels laminated to outer sides thereof. U.S. Pat. No. 4,881,352 to Glockstiein discloses a wall having gypsum panels secured to opposing sides of a centrally located metal stud. The wall disclosed by Glockstiein is filled with a material which provides thermal and acoustic insulating properties. U.S. Pat. No. 3,462,892 discloses an adaptor wall having utility modules supported in the wall, but the wall is hollow and does not include a solid core.

Accordingly, it is an object of this invention to provide a reconfigurable and reusable wall system incorporating solid core panels which are arranged to provide improved fire resistance and acoustical resistance. It is a further object of this invention to provide a solid core partition wall system which is reconfigurable and reusable, provides improved fire resistance and acoustical resistance, and which extends from floor to ceiling to provide a level of privacy equivalent to that of a conventional permanent drywall construction. Another object of this invention is to provide a solid core partition wall which is reconfigurable and reusable, which will provide improved fire resistance and acoustical resistance, and which includes means for releasably attaching an outer covering or skin thereto. A still further object of this invention is to provide a reconfigurable and reusable solid core partition wall system exhibiting improved fire resistance and acoustical resistance, and having means for facilitating mounting of utility modules, such as for electrical receptacles, means for mounting furniture to the wall system, and means for facilitating attachment of walls from the partition system at generally any location along the wall system.

SUMMARY OF THE INVENTION

In this invention, a reconfigurable and reusable wall panel system includes solid core partition wall panels which are interconnected in a manner which achieves improved fire resistance and acoustical resistance. The modular wall system includes a plurality of wall panels having a solid structural core, and which are connected directly to each other in edge to edge relationship. The system also includes a plurality of spaced apart structural studs which are attached to opposite faces of the wall panels, and a plurality of cover panels which are attached to outboard faces of the studs. The edge to edge connection between adjacent solid core partition wall panels eliminates the need for hollow studs interposed between adjacent wall panels, thus providing a substantially continuous solid core wall which extends along the entire length of the wall system. The structural studs which are attached to the opposite faces of the solid core partition wall panels provide means for releasably attaching wall covering panels to the modular wall system.

The core wall panels include a solid structural core comprising off-set gypsum panels which form opposing lip edges, each of which is adapted to connect to an adjacent core wall panel. More specifically, the lip edge of each panel overlaps a lip edge of an adjacent panel to form a lapped joint which provides improved sound and fire insulation properties as compared with known solid core wall panel systems.

A particular aspect of the invention is the provision of a modular wall system having solid core partition wall panels which provide improved fire resistance and acoustical resistance, and which includes means for mounting electrical receptacles and/or other utilities in the wall system. The system includes a plurality of interconnected panels, each of which has a solid structural core; a plurality of spaced apart structural studs attached to opposite faces of the panels; a plurality of cover panels attached to outboard faces of the studs; and a utility module positioned in a cut-out aperture in one of the solid core panels and supported by adjacent studs.

In accordance with another particular aspect of the invention, a solid core wall panel system having improved fire resistance and acoustical resistance is provided with a horizontal support strap or rail for supporting furniture, wall coverings or skins, or brackets for connecting an off-wall perpendicular to the wall system.

The solid core partition wall panels and wall systems provide better acoustic and fire resistance properties, are reconfigurable and reusable, can be configured for floor to ceiling privacy, and include releasably attached wall coverings or skins which allow greater flexibility in the selection of wall coverings and allow wall coverings to be changed more easily if desired. Because the wall systems are reconfigurable and reusable, rather than a permanent architectural feature of a building, they can have a lower life cycle cost than drywall construction which must be torn down and disposed of if reconfiguration of walls is required. Additionally, because the wall systems are reconfigurable and reusable, ownership can remain with a building tenant, so that the building tenant can disassemble the wall system and transport it and reuse it at a different location if desired. Also, because the wall system is portable, rather than a permanent architectural feature of a building, it can be depreciated over a shorter depreciation period. A further advantage is that the wall systems can be provided with power/data distribution capabilities, and can be easily modified or adapted to contain a utility module for supporting electrical receptacles or the like. The wall systems can also be provided with means for easily mounting furniture, off-walls, and the like.

BRIEF DESCRIPTION OF THE DRAWINGS

FIG. 1 is an exploded perspective view of an embodiment of the invention;

FIG. 2 is a perspective view of a structural stud which is attached to opposite faces of the solid core wall panels, and which is used for supporting the wall covering panels;

FIG. 3 is an enlarged fragmentary perspective view of a lower portion of the structural stud shown in FIG. 2;

FIG. 7 is a fragmentary sectional view along lines VII—VII of FIG. 1;

FIG. 9 is a fragmentary sectional view along lines IX—IX of FIG. 8, with an electrical receptacle, associated electrical conduit, and expressway cover plates mounted on the wall system;

FIG. 10 is a perspective view of a partially assembled wall system including horizontal straps or rails connected to adjacent spaced apart vertical structural studs for supporting wall coverings or skins, furniture components, or off-walls;

FIG. 11 is an enlarged perspective view showing the details of the connection between the horizontal straps or rails and the vertical studs shown in FIG. 10;

FIG. 18 is a perspective view of a partially assembled wall panel system having a binder bin attached thereto;

FIG. 21 is a fragmentary, horizontal sectional view showing two solid core wall panels interconnected with a post in an L-shaped arrangement;

DESCRIPTION OF THE PREFERRED EMBODIMENTS

Figures 4, 5, 9A:
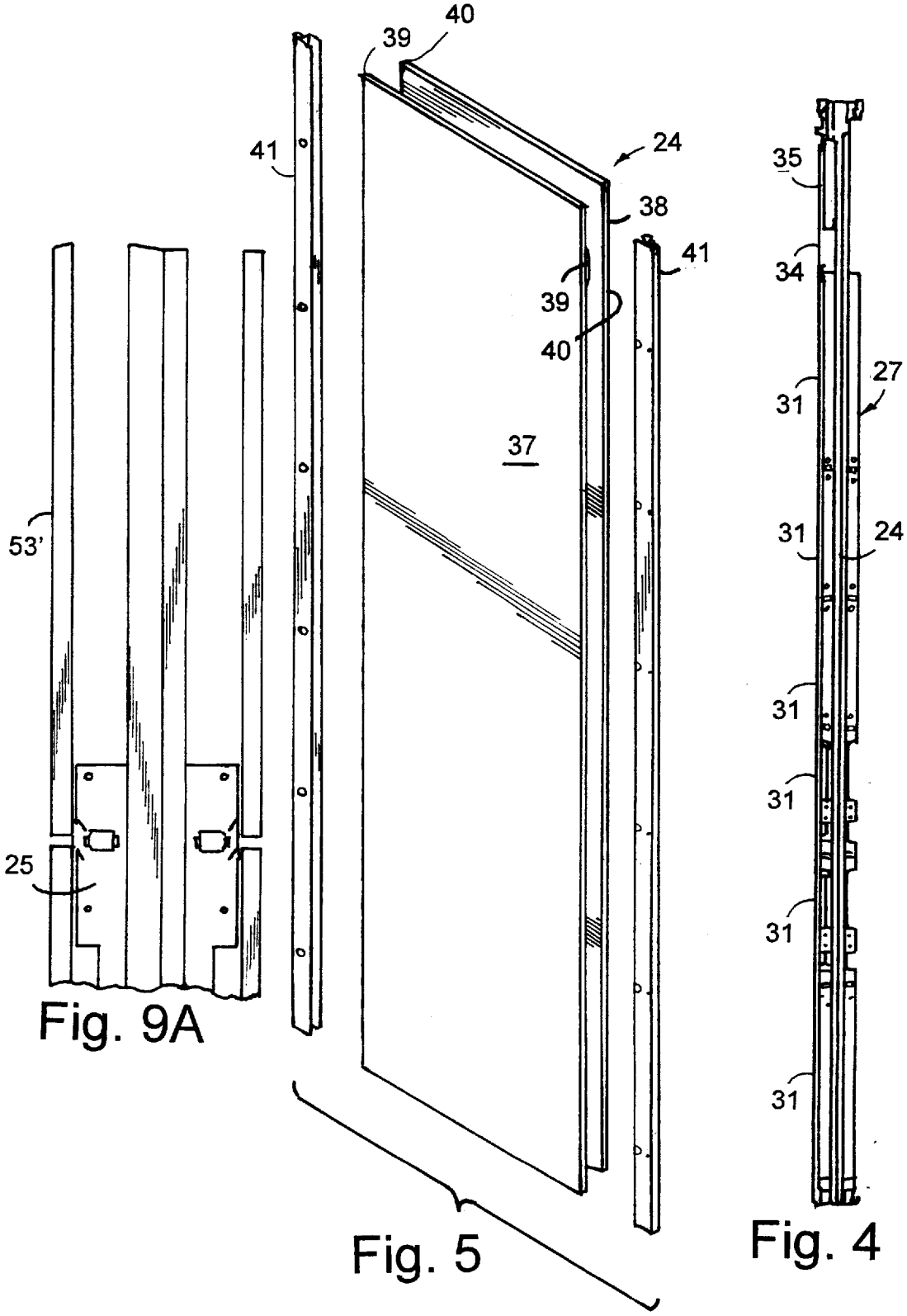
FIG. 4 is an end view of the modular wall system shown in FIG. 1.
FIG. 5 is an exploded perspective view of the solid core wall panels shown in FIG. 1, showing the manner in which the wall panels are constructured.
FIG. 9A is a transverse cross-sectional view of the wall panel system 10 showing an alternative configuration wherein the optional expressway channel shown in FIG. 9 is omitted.

An exploded perspective view of a wall panel system embodying the invention is shown in FIG. 1 to illustrate the manner in which the wall panel assembly is assembled. The wall panel system 10 includes a floor track 21, a top track 22, a ceiling core channel 23, and a plurality of interconnected solid core panels 24. The floor track 21 and core channel 23 each include a center channel 21A and 23A respectively, and side channels 21B and 22B respectively disposed on opposite sides of the respective center channels. The solid core panels include a top edge which is disposed in central channel 23A of core channel 23, and a bottom edge which is disposed in center channel 21A of floor track 21. A plurality of adjustable studs 25 are positioned on opposite sides of the solid core panels 24. Studs 25 include leveler feet 26 which fit into the side channels 21B of floor track 21.

The leveler feet 26 allow adjustment of each side of the wall system 10 separately so that the skins and any furniture of utility modular supported by the studs 25 can be raised and lowered together. Studs 25 also include a pair of spaced apart sections 27, each having a square transverse cross-sections shape, and each having a pattern of apertures therein. On the faces of the square tube sections 27, the pattern includes three apertures, one being a plus-shaped center aperture 28 and the others being oblong apertures 29 and 30 which are located above and below the plus-shaped center aperture. These three apertures are repeated at predetermined heights on stud 25, so that wall covering panels or skins 31 can be mounted on the studs by engaging top locators 32 in apertures 28 and bottom connectors 33 in upper oblong apertures 29. As is best illustrated in FIG. 4, studs 25 do not extend to the ceiling. Instead, an expressway channel 34 is mounted along the upper end of studs 25, and custom cut transom wall covering panels or skins 35 extend between expressway channel 34 and the side channels 22B on side track 22 outboard of the center channel 23A of ceiling core channel 23.

Figure 6:
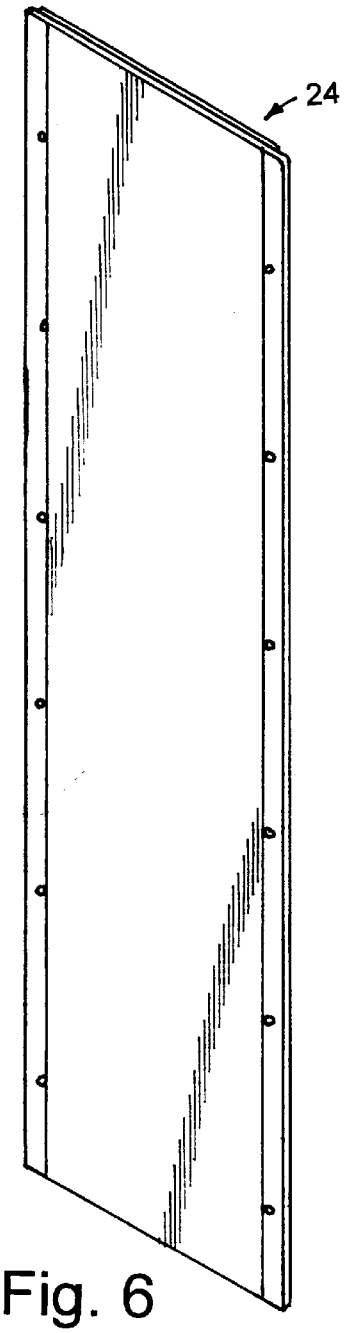
FIG. 6 is a perspective view of the solid core partition wall panel in an assembled state.

With reference to FIGS. 5, 6 and 7, solid core panels 24 are comprised of drywall (e.g., gypsum) panels 37 and 38 which are bonded together. Panels 37 and 38 are sized and bonded together so that the edges 39 of panel 37 overhang the edges 40 of panel 38 whereby a lip is formed on each of the opposite sides of the solid core panel 24. A roll-formed sheet metal edger or core channel 41 is attached to the vertical side edges of the solid core panel 24 to protect and reinforce the edges thereof. The inside center flange 42 of edger 41 includes a ridge 43 and an adjacent groove 43'. Ridge 43 and groove 43' are configured to interlock with the ridge and groove of an adjacent interconnected solid core panel to form an interlocking lap joint as shown in FIG. 7. Ridges 43 interlock to provide a rigid assembly that cannot be easily pulled apart. Self drilling screws 44 extend through the joint at ridges 43 to connect adjacently aligned core panels 24.

Figure 8:
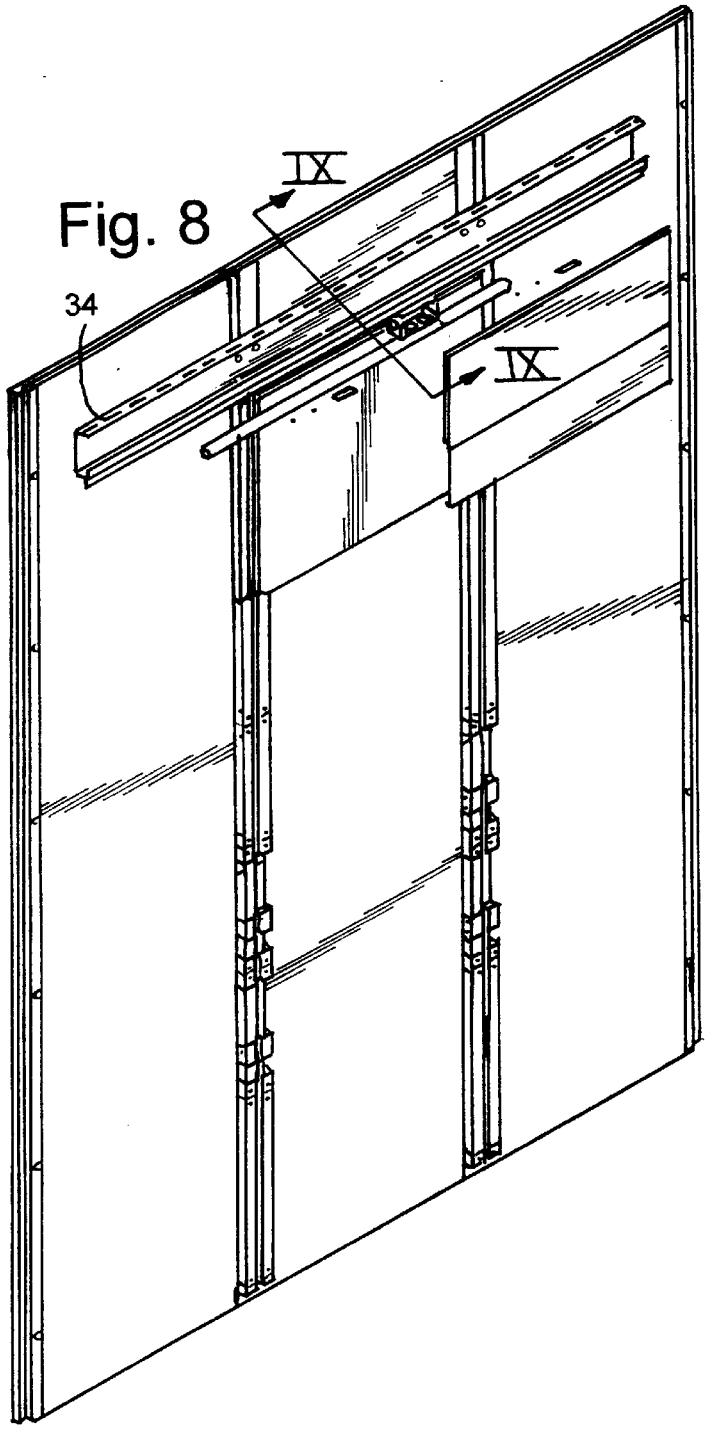
FIG. 8 is a perspective view of a partially assembled wall panel system having an expressway channel mounted on an upper portion thereof for routing utilities, such as electrical receptacles and associated conductors.

Installation of the wall panel system 10 involves anchoring floor track 21 to a floor and anchoring top track 22 to a ceiling in a conventional manner such that the tracks are arranged in an overlapping relationship so as to define a vertical plane in which the wall panel system is to be installed. Ceiling core channel 23 is then snap-attached to the top track 22. The solid core panels 24 are then installed by inserting the upper edge of each solid core panel 24 into center channel 23A of ceiling core channel 23 and dropping the lower edge of each of the solid core panels 24 into the center channel 21A of floor track 21. Panels 24 are then securely connected together with the self drilling screws 44 (FIG. 7). Studs 25 include a plurality of vertically spaced apart pairs of key slots 45 which engage corresponding pre-assembled buttons 45 on core channel 41 to facilitate lay-on installation of studs 25 over the joints formed between connected adjacent panels 24. This key slot and button relationship allows the stud 25 to slide in the vertical direction only. Expressway channel 34 can be mounted to studs 25 as shown in FIG. 8, either before or after studs 25 are attached to the interconnected wall panels 24. As can be seen in FIG. 8, stud 25 terminates below the top edge of panels 24, at the lower edge of expressway channel 34. Mounting of expressway channel 34 is generally desired but is optional. Attachment of expressway channel 34 is best understood by comparing FIG. 9 which shows the optional expressway channel 34 installed, and FIG. 9A which shows the finished construction of the wall panel system without the optional expressway channels installed. Also shown in FIG. 9 is attachment of an expressway cover 48 which attaches by clip 49 to outer lower flange 50 of expressway channel 34. A transom clip 51 fits into a slot in the top of expressway channel 34 for engaging a bottom connector 52 on transom skin 53. Conduit or other utilities 54 can be routed along the inside of expressway channel 34. With respect to the alternative configuration shown in FIG. 9A, wherein the optional expressway channel 34 is omitted, a longer transom skin 53' is utilized to close off the space between the ceiling core channel 23 and the top of stud 25.

Where the transom extends over a glass wall facade (or doorway opening), a clere story or single panel can be supported on a clere story bracket above the expressway.

Horizontal rails 46 (FIGS. 10 and 11) are attached by screws 55 into side holes 56 and 57 located above and below the plus-shaped apertures 58 on the sides of studs 25. Horizontal rails 46 include a regular pattern of apertures including plus-shaped center apertures 28' and oblong apertures 29' and 30', located above and below the plus-shaped aperture respectively. The apertures 28', 29' and 30' are spaced 1 inch apart and are horizontally aligned with apertures 28, 29 and 30 on stud 25. The apertures 28, 29 and 30 and the apertures 28', 29' and 30' define a continuous horizontal roll of apertures spaced 1 inch apart, except in the center of stud 25 where a single aperture is missing.

Figure 12:
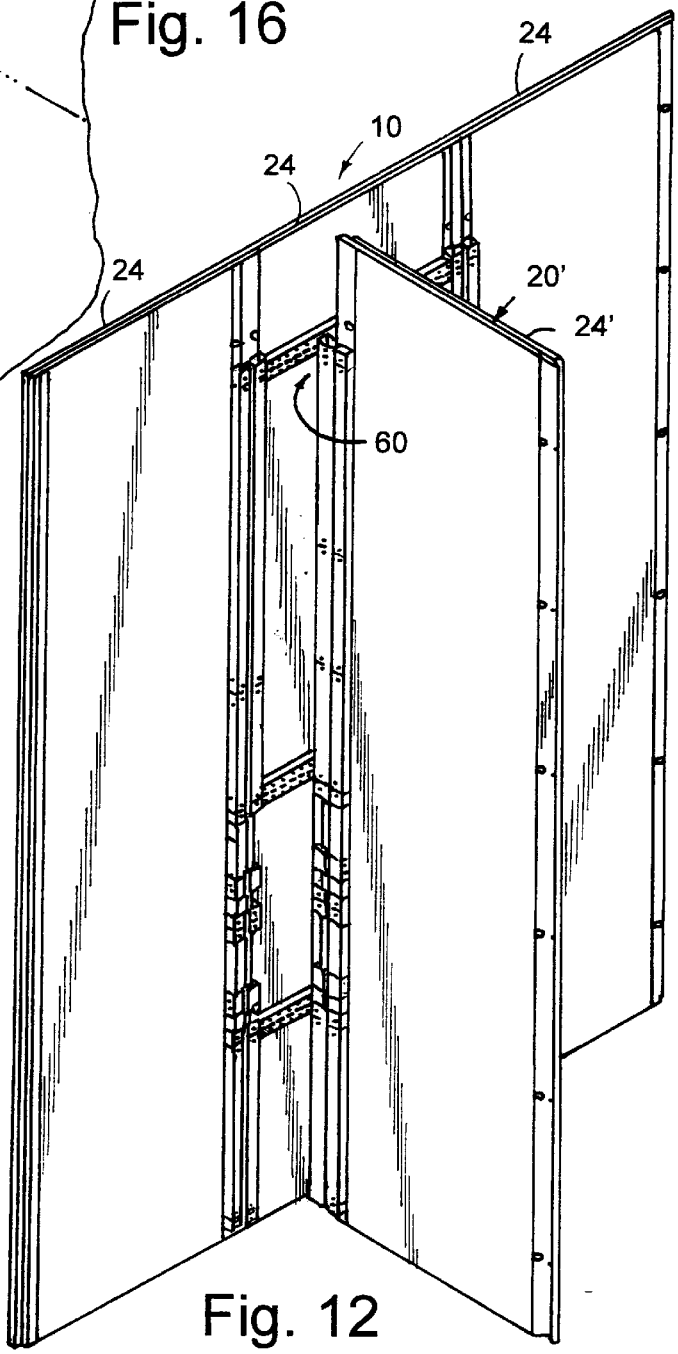
FIG. 12 is a perspective view of an off-wall attached to the wall panel system and extending perpendicularly therefrom.
Figure 13:
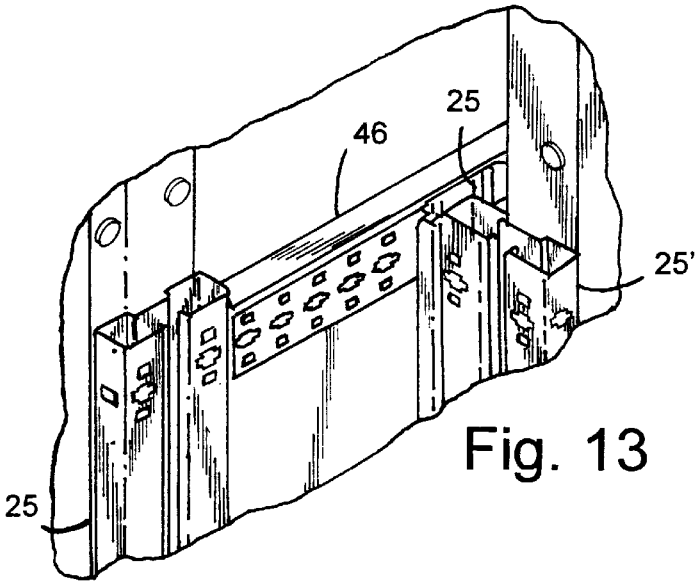
FIG. 13 is an enlarged, fragmentary perspective view showing details of the interconnection between the off-wall and the horizontal straps or rails shown in FIG. 12.
Figure 14:
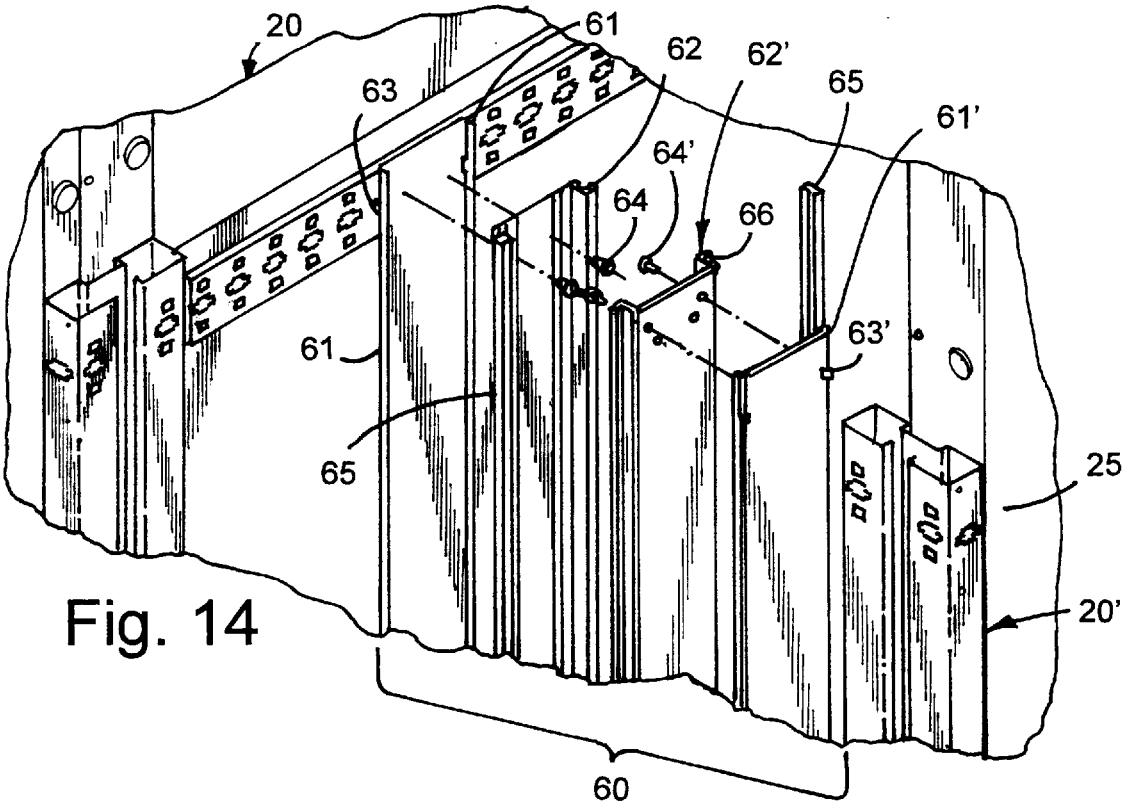
FIG. 14 is an enlarged, fragmentary, exploded perspective view showing details of the mounting system used for connecting the off-wall shown in FIG. 12 to the wall system, and showing the manner in which the mounting system is assembled.

An off-link wall 20' (FIG. 12) is attached to wall panel system 10 by a wall connector 60. Wall connector 60 includes an off-module plate 61 (FIGS. 13, 14) and an off-module extrusion 62 attached by hook 63 and screw 64 to horizontal rail 46 at a selected location on link wall 20. A second off-module plate 61' and off-module extrusion 62' are attached by hook 63' and screw 64' to a pair of studs 25 at the end of wall 20'. A pair of extruded elongate connector clips 65 grip the flared edges 66 of off-module extrusion 62 and 62' to securely connect wall 20' to wall panel system 10. Because off-module plate 61 can be mounted in any of a plurality of different locations corresponding to the uniformly spaced apart sets of apertures on studs 25 and horizontal rail 46, wall 20' can be mounted at generally any location off of wall panel system 10.

Figure 17:
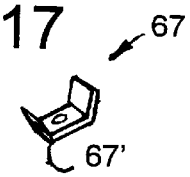
FIG. 17 is a perspective view of the connector attached to the off-wall and engaging the off-wall bracket shown in FIG. 16.
Figure 16:
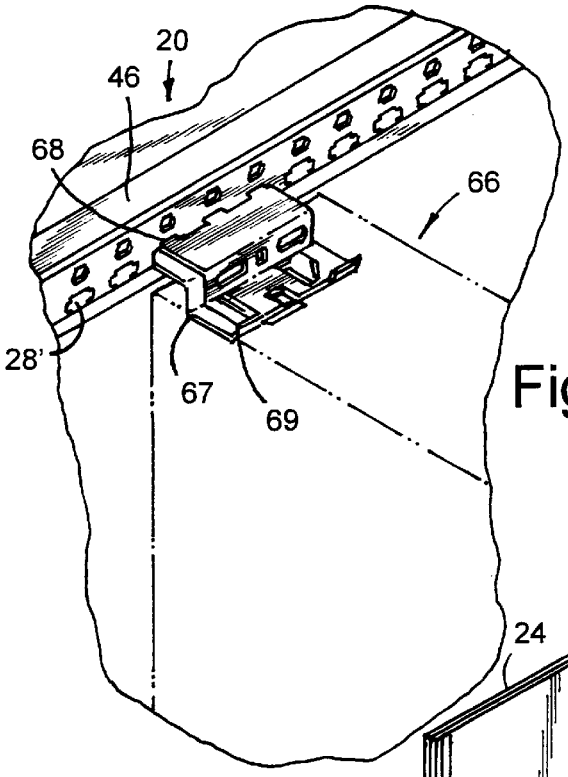
FIG. 16 is an enlarged, fragmentary perspective view showing details of the offwall bracket shown in FIG. 15.
Figure 15:
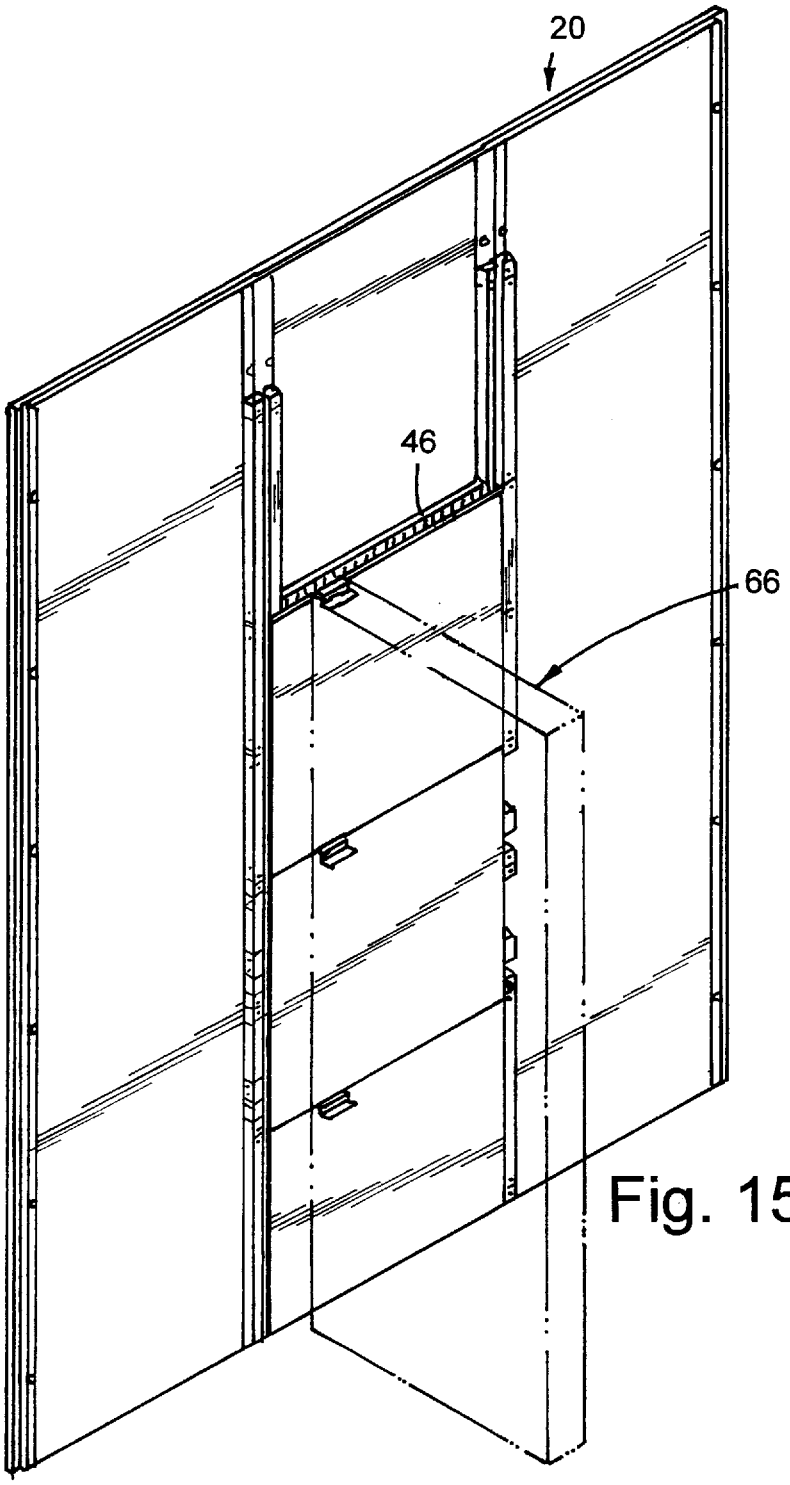
FIG. 15 is a perspective view of a partially assembled wall panel system utilizing alternative off-wall mounting brackets for connecting an off-wall (shown in Phantom) to the wall panel system.

Off-module connection of a zone wall partition frame 66 to a wall panel system 10 is shown in FIGS. 15 and 16. A zone wall off-module bracket 67 is configured for mating connection to a connector 67' in a mating connector on zone wall frame 66. The illustrated zone wall off-module bracket 67 includes teeth 68 for engaging the center of slots 28' in the horizontal rail 46. A second end 69 of the bracket 67 is configured for mating connection to the zone wall frame 66 by engagement of a connector piece 67'. The zone wall frame 66 can be connected at multiple heights for stability and can be attached at multiple locations corresponding with the various sets of aperture in rail 46. Connector piece 67' is more clearly illustrated in FIG. 17. Connector piece 67' includes a base which is attached to the upper edge of the partition frame 66, and includes a pair of upwardly projecting tabs which extend through slots in bracket 67 for connecting partition frame 66 to wall panel system 10.

Figure 19:
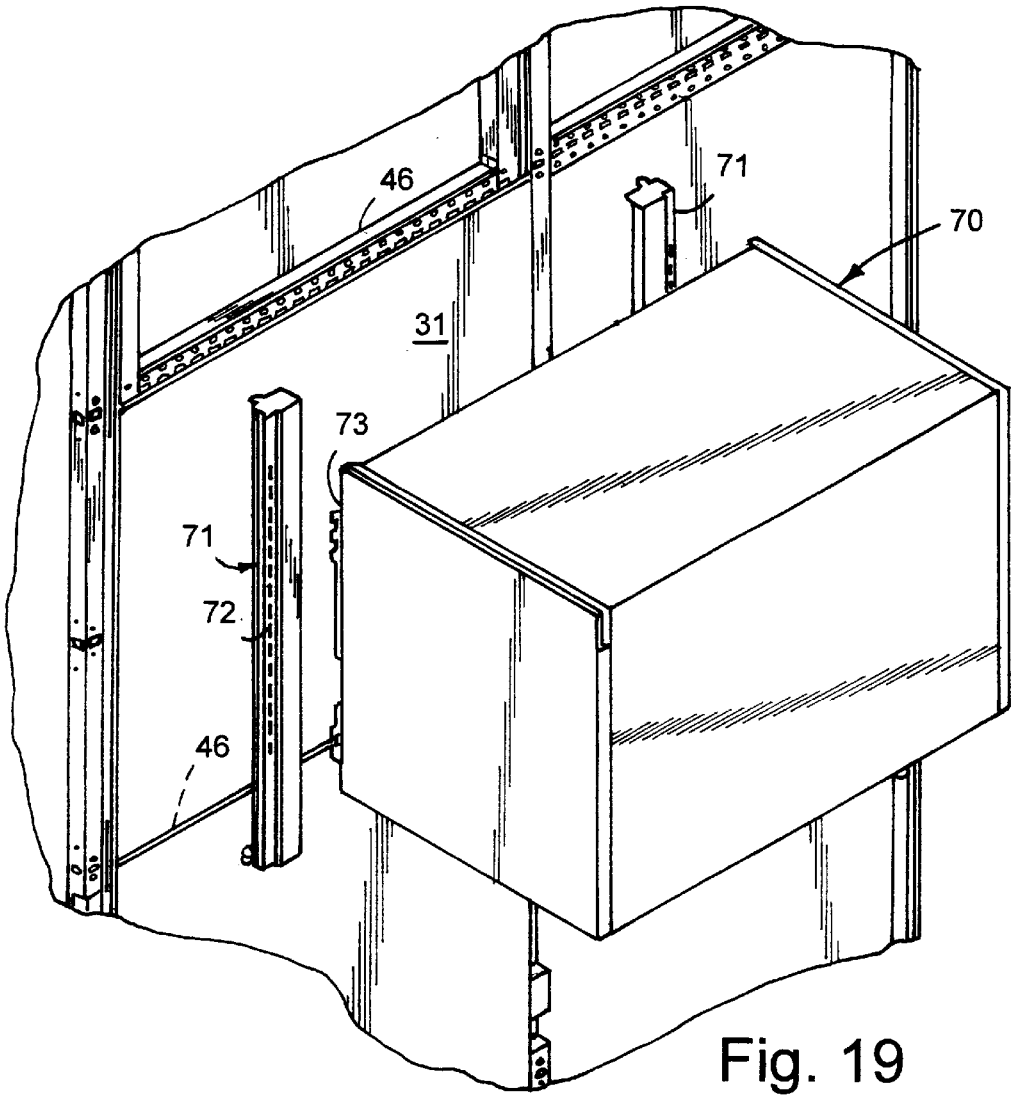
FIG. 19 is an enlarged, exploded, fragmentary perspective view of the wall system and binder bin shown in FIG. 18, and illustrating the manner in which the binder bin is attached to the wall panel system.

Binder bins 70 (FIGS. 18 and 19) can be incorporated into wall panel system 10. Binder bin brackets 71 are extended vertically between adjacent horizontal rails 46 and are configured to engage rails 46 over the top of skins or wall coverings 31. Bracket 71 includes a vertical row of slots 72. Binder bins 70 includes hooks 73 configured to engage selected ones of the vertical slots 72.

Figure 20:
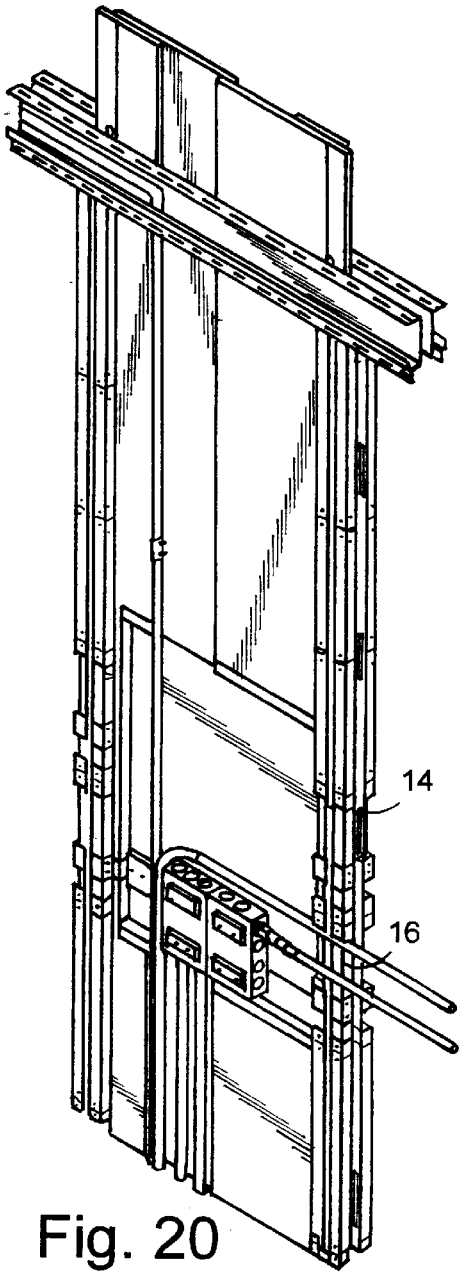
FIG. 20 is a perspective view of a utility panel incorporated into a wall panel of the wall system.
Figure 20A:
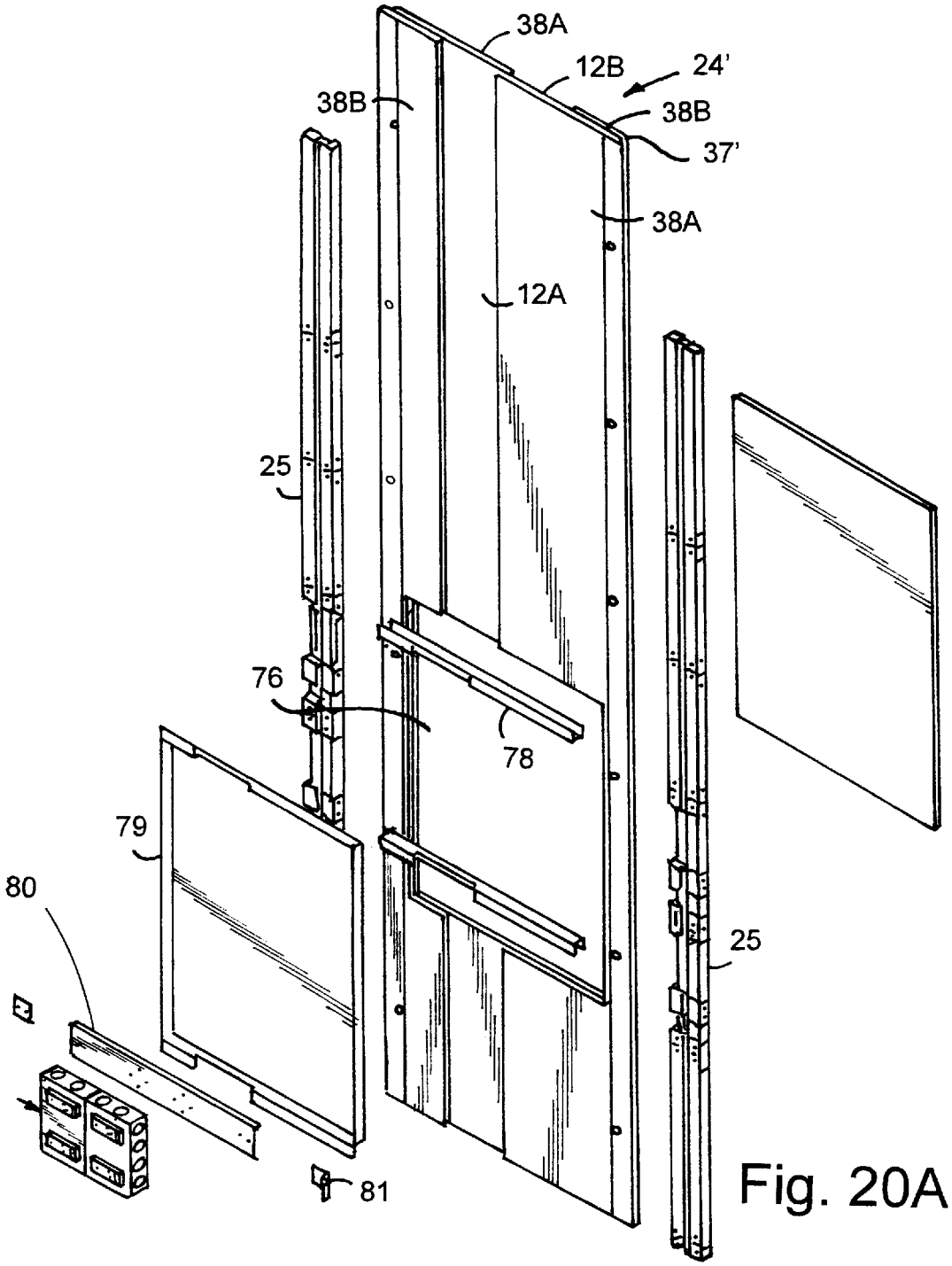
FIG. 20A is an exploded perspective view showing the manner in which the utility panel is installed on the wall panel shown in FIG. 20.

A utility panel 75 (FIGS. 20 and 20A) can be incorporated into the wall system 10. A section of drywall panels 37 and 38 is cut away to form an opening 76 in core wall 24. Edge channels 77 and 78 are fit along at least the top and bottom edges of the opening 76, and a divider pan 79 is fit into the opening 76 and attached to edge channel 77 and 78. A box support channel 80 is secured to studs 25 by stud channel brackets 81. A junction box 82 is secured to box support channel 80. Junction box 82 includes a receptacle 83 and junction box cover 84. Utility panel 75 can be formed in wall panel system 10 facing either direction. Accordingly, adjacent panels 24 can be provided with utility panels 75 which can either both face in the same direction or in opposite directions. As shown in FIG. 20, the core panels 24' in which utility panels 75 are mounted differ from panels 24 in that they are comprised of a core panel 37' and spaced apart wide and narrow panels 38A and 38B on each side of panel 37'. The resulting panel 24' has substantially the same transverse cross-sectional shape as panels 24 except that vertical recesses 12A and 12B are provided on opposite sides of the panel 24'. As shown in FIG. 20, conduit can be vertically routed from the floor through recess 12A to utility panel 75, vertically from utility panel 75 to expressway channel 34, or horizontally through cut-outs 14 and 16 in studs 25. Cut-outs 14 and 16 in studs 25 provide on area for installation of optional beltway channels for power and data distribution.

Figure 23:
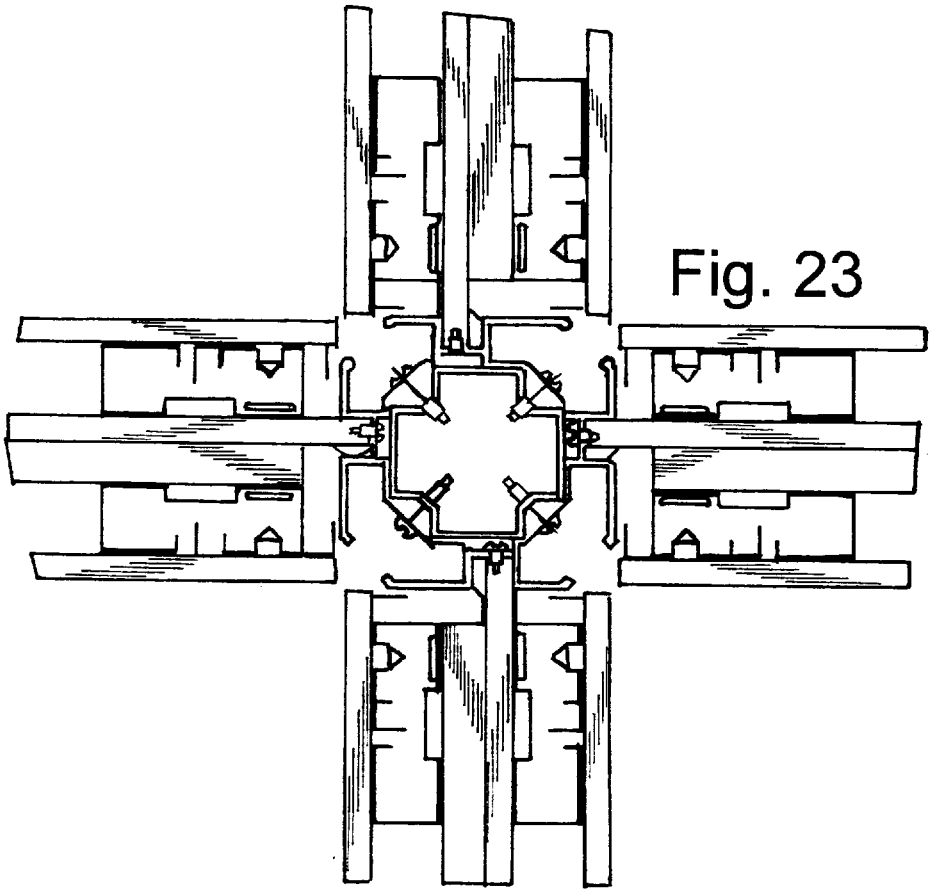
FIG. 23 is a fragmentary, horizontal sectional view showing four solid core wall panels interconnected with a post in an X-shaped arrangement.
Figure 22:
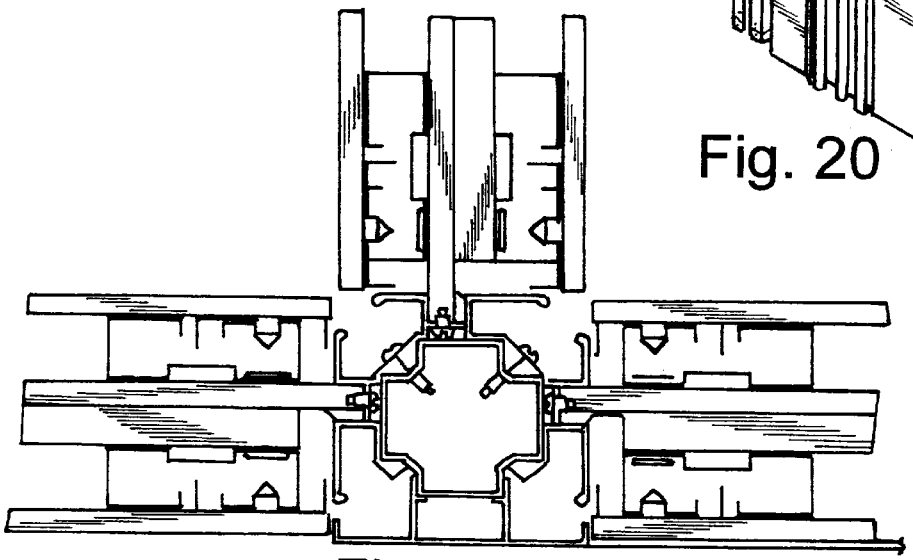
FIG. 22 is a fragmentary, horizontal sectional view showing three solid core wall panels interconnected with a post in an T-shaped arrangement.

With reference to FIGS. 21, 22 and 23 wall panel systems 10 can be interconnected with posts in an L-shaped arrangement, a T-shaped arrangement, or an X-shaped arrangement.

It will be apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A modular wall comprising:

a plurality of edge connected solid panels, the panels each having inner and outer opposite faces and lipped edges connected to an adjacent panel to form overlapped joints between the panels;

a plurality of spaced apart structural studs each having inboard and outboard faces and being attached to one of the inner and outer opposite faces of the panels, wherein one of said stud faces is in contact with one of the solid panel faces; and a plurality of cover panels attached to the other of the inner and outer outboard faces of the studs.

2. The modular wall of claim 1, wherein the solid panels are gypsum.

3. The modular wall of claim 2, wherein the panels further comprise a roll-formed sheet metal core channel which is attached to the vertical side edges of the panels to protect and reinforce the vertical side edges of the panels.

4. The modular wall of claim 3, wherein the core channel includes a ridge and an adjacent groove which engage a ridge and groove of an adjacent connected panel to provide an interlocked overlapping joint between the adjacent panels.

5. The modular wall of claim 1, wherein the studs include leveler feet at a bottom end thereof which allow adjustment of each side of the wall system separately so that the cover panels and any furniture or utility modules supported by the studs can be raised or lowered together without lifting the structural core.

6. The modular wall of claim 1, wherein the studs include a pattern of apertures which are repeated at predetermined heights on the stud so that the cover panels can be mounted on the studs by engaging connectors on the cover panels with apertures on the studs.

7. The modular wall of claim 1 further comprising a horizontal expressway channel mounted on the top of the structural studs to provide a space recessed within the wall for routing utilities.

8. The modular wall system of claim 1 further comprising horizontal rails interconnecting adjacent studs, the studs and straps including apertures defining a continuous horizontal row of apertures for supporting cover panels, furniture components, off-walls, or a combination thereof.

9. A solid core wall comprising:

a solid structural core comprising off-set gypsum panels forming a lipped edge connected to an adjacent solid core wall panel, the panels comprising a roll-formed sheet metal core channel which is attached to the vertical side edges of the panels to protect and reinforce the vertical side edges of the panels, the core channel including a ridge and an adjacent groove which engage a ridge and groove of an adjacent connected panel to provide an interlocked overlapping joint between the adjacent panels.

10. A modular wall comprising:

a plurality of interconnected solid panels, each have opposite faces;

a plurality of spaced apart structural studs having inboard and outboard faces and being attached to the opposite faces of the panels;

a plurality of cover panels attached to outboard faces of the studs opposite that of the face in contact with said panels;

a cut-out aperture defined in one of the solid core panels, and a utility module positioned in the cut-out aperture and supported by adjacent studs, wherein the solid structural core comprises off-set gypsum panels forming a lipped edge adapted to connect to an adjacent panel having a solid structural core, the panels further comprising a roll-formed sheet metal core channel which is attached to the vertical side edges of the panels to protect and reinforce the vertical side edges of the panels.

11. The modular wall of claim 10, wherein the core channel includes a ridge and an adjacent groove which engage a ridge and groove of an adjacent connected panel to provide an interlocked overlapping joint between the adjacent panels.

12. The modular wall of claim 10, wherein the studs include leveler feet at a bottom end thereof which allow adjustment of each side of the wall system separately so that the cover panels and any furniture or utility modules supported by the studs can be raised or lowered together while the structural core remains stationary.

13. The modular wall of claim 10, wherein the studs include a pattern of apertures which are repeated at predetermined heights on the stud so that the cover panels can be mounted on the studs by engaging connectors on the cover panels with apertures on the studs.

14. The modular wall of claim 10 further comprising a horizontal expressway channel mounted on the top of the structural studs to provide a space recessed within the wall for routing utilities.

15. The modular wall of claim 10 further comprising horizontal rails interconnecting adjacent studs, the studs and straps including apertures defining a continuous horizontal roll of apertures for supporting cover panels, furniture components, off-walls, or a combination thereof.

16. The core wall panel of claim 9, wherein the solid structural core comprises off-set gypsum panels forming a lipped edge adapted to connect to an adjacent panel having a solid structural core.

17. The core wall panel of claim 16, wherein the panels further comprise a roll-formed sheet metal core channel which is attached to the vertical side edges of the panels to protect and reinforce the vertical side edges of the panels.

18. The core wall panel of claim 17, wherein the core channel includes a ridge and an adjacent groove which engage a ridge and groove of an adjacent connected panel to provide an interlocked overlapping joint between the adjacent panels.

19. The core wall panel of claim 18, wherein the studs include leveler feet at a bottom end thereof which allow adjustment of each side of the wall system separately so that the skins and any furniture or utility modules supported by the studs can be raised or lowered together without the structural core moving.

20. The core wall panel of claim 16, wherein the studs include a pattern of apertures which are repeated at predetermined heights on the stud so that the cover panels can be mounted on the studs by engaging connectors on the cover panels with apertures on the studs.

21. The core wall system of claim 16 further comprising a horizontal expressway channel mounted on the top of the structural studs to provide a space recessed within the wall for routing utilities.

22. A solid core wall panel comprising:

first and second gypsum panels, each of the gypsum panels having opposite faces and opposite lateral edges, a face of the first gypsum panel being bonded to the face of the second gypsum panel to define a unitary solid structural core having opposite vertical side edges, the lateral edges of the first gypsum panel being off-set from the lateral edges of the second gypsum panel to define a lip at each of the opposite vertical side edges of the solid structural core; and an edge member attached to each of the vertical side edges of the unitary solid structural core to protect and reinforce said vertical side edges.

23. The solid core wall panel of claim 22, wherein the edge member defines a ridge and an adjacent groove configured to mate with an adjacent solid structural core and interlock therewith.

24. The solid core wall panel of claim 22, wherein the edge member comprises a roll-formed sheet metal core channel.

* * * * *

UNITED STATES PATENT AND TRADEMARK OFFICE

CERTIFICATE OF CORRECTION

PATENT NO. : 5,870,867
DATED : February 16, 1999
INVENTOR(S) : Terry Mitchell

It is certified that error appears in the above-identified patent and that said Letters Patent is hereby corrected as shown below:

Column 1, line 4, "walls systems" should be --wall systems--.

Column 1, line 48, "the do" should be --they do--.

Column 2, lines 6 and 8, "Glockstiein" should be --Glockstein--.

Column 4, line 45, "an T-shaped" should be --a T-shaped--.

Column 6, lines 12 and 13, "clere story" should be--clerestory--.

Column 7, line 23, "on area" should be --an area--.

Column 8, claim 8, line 8, delete "system".

Column 8, claim 10, line 33, before "panels" insert --solid--.

Column 10, claim 21, line 1, delete "system".

Signed and Sealed this

Seventeenth Day of August, 1999

*Attest:*

Q. TODD DICKINSON

*Attesting Officer*

*Acting Commissioner of Patents and Trademarks*